US008867906B2

(12) United States Patent
Watson et al.

(10) Patent No.: US 8,867,906 B2
(45) Date of Patent: Oct. 21, 2014

(54) DRY FIRE PROTECTION SYSTEM

(75) Inventors: Eric K. Watson, Crestwood, KY (US); Jonathan D. Nelson, Louisville, KY (US); Denis Alagic, Louisville, KY (US); David Hicks, Louisville, KY (US); Neil Philip Smith, Milan (IT); Frederick Pizzella, Emporium, PA (US)

(73) Assignee: General Electric Company, Schenectady, NY (US)

( * ) Notice: Subject to any disclaimer, the term of this patent is extended or adjusted under 35 U.S.C. 154(b) by 1615 days.

(21) Appl. No.: 12/267,081

(22) Filed: Nov. 7, 2008

(65) Prior Publication Data

US 2010/0116812 A1 May 13, 2010

(51) Int. Cl.

| | |
|---|---|
| ***F24H 1/20*** | (2006.01) |
| ***F24H 9/20*** | (2006.01) |
| ***H05B 1/02*** | (2006.01) |

(52) U.S. Cl.

CPC ..... *H05B 1/0269* (2013.01); *F24H 9/2021* (2013.01); *F24H 1/202* (2013.01)

USPC ..... 392/451; 219/494; 219/482

(58) Field of Classification Search

USPC ..... 219/481, 482, 486, 489, 497; 392/441–464

See application file for complete search history.

(56) References Cited

U.S. PATENT DOCUMENTS

| | | | | |
|---|---|---|---|---|
| 5,054,108 | A | 10/1991 | Gustin et al. | |
| 5,159,318 | A | 10/1992 | Kronberg | |
| 5,949,960 | A | 9/1999 | Hall | |
| 6,080,973 | A | 6/2000 | Thweatt, Jr. | |
| 6,137,955 | A | 10/2000 | Krell et al. | |
| 6,242,720 | B1 * | 6/2001 | Wilson et al. | 219/486 |
| 6,265,699 | B1 | 7/2001 | Scott | |
| 6,847,782 | B1 | 1/2005 | Kovacs | |
| 6,976,636 | B2 * | 12/2005 | Thweatt, Jr. | 236/21 B |
| 8,080,766 | B2 * | 12/2011 | Frock et al. | 219/401 |
| 2007/0177858 | A1 * | 8/2007 | Knoeppel et al. | 392/451 |
| 2007/0183758 | A1 * | 8/2007 | Bradenbaugh | 392/478 |

* cited by examiner

*Primary Examiner* — Brian Jennison

(74) *Attorney, Agent, or Firm* — Global Patent Operation; Douglas D. Zhang

(57) ABSTRACT

A dry fire protection system for a water heater is provided. The water heater includes a body having an elongated hollow for holding water to be heated, an inlet opening and an outlet opening in communication with the hollow for flowing water therethrough. A heating element is coupled to the body for heating the water within the hollow. The dry fire protection system comprises a sensing element disposed in the hollow of the body for detecting the presence of water in the hollow. The sensing element is spaced from and operably connected to the heating element. The sensing element is configured to generate a voltage in response to a temperature of the sensing element. A controller is operably connected to the sensing element for monitoring the generated voltage across the sensing element. The controller is configured to prevent a supply of electrical power to the heating element as a function of the generated voltage.

20 Claims, 8 Drawing Sheets

DRY FIRE PROTECTION SYSTEM

BACKGROUND

The present invention generally relates to apparatus for heating liquids and, more particularly, to providing dry fire protection for resistance type heating elements in electric water heaters.

Electric water heaters are used to heat and store a quantity of water in a storage tank for subsequent on-demand delivery to plumbing fixtures such as sinks, bathtubs and showers in both residences and commercial buildings. The electric water heaters typically utilize one or more electric resistance heating elements to supply heat to the tank-stored water under the control of a thermostat which monitors the temperature of the stored water.

An electric water heater is sold without water in it and is filled with water after it is moved to and installed in its intended operation location. The possibility exists that the water heater can be "dry fired", i.e., have its electric resistance type heating element(s) energized before the storage tank is filled with water to immerse the heating element(s) projecting into its interior. When such dry firing occurs, each dry fired electric heating element typically burns out, resulting in a return of the unit to the manufacturer, or a service call by a repair technician to perform an on-site element replacement. The cost of either repair procedure can be quite substantial.

Various solutions have previously been proposed to prevent the firing of heating elements in electric water heaters unless the elements are immersed in water introduced into the storage tank of the water heater. Primarily, these proposed solutions have taken two forms, float switch-based protective systems and temperature sensor-based protective systems. However, neither of these previously proposed dry fire protection techniques has proven to be entirely satisfactory. For example, each tends to be fairly complex and undesirably expensive to incorporate into the overall water heater assembly. Additionally, these previously proposed systems have often proven to be unreliable, and tend to be undesirably invasive of the interior of the storage tank portion of the water heater.

In view of the foregoing, a need exists for improved dry fire protection system which overcomes certain difficulties with the prior art designs while providing better and more advantageous overall results.

BRIEF DESCRIPTION

In accordance with one aspect of the present disclosure, a dry fire protection system for a water heater is provided. The water heater includes a body having an elongated hollow for holding water to be heated, an inlet opening and an outlet opening in communication with the hollow for flowing water therethrough. A heating element is coupled to the body for heating the water within the hollow. The dry fire protection system comprises a sensing element disposed in the hollow of the body for detecting the presence of water in the hollow. The sensing element is spaced from and operably connected to the heating element. The sensing element is configured to generate a voltage in response to a temperature of the sensing element. A controller is operably connected to the sensing element for monitoring the generated voltage across the sensing element. The controller is configured to prevent a supply of electrical power to the heating element as a function of the generated voltage.

In accordance with another aspect of the present disclosure, a method of controlling a heating element of a water heater to prevent dry fire is provided. A sensing element includes a positive temperature coefficient (PTC) element. The PTC element is positioned in the water heater. Voltage across the PTC element is sensed prior to energization of the heating element. The sensed voltage is compared to a threshold voltage. Electrical power supplied to the heating element is controlled as a function of the sensed voltage across the PTC element.

In accordance with yet another aspect of the present disclosure, a water heater comprises a body having an elongated hollow for holding water to be heated. An inlet opening and an outlet opening are in communication with the hollow for flowing water therethrough. A heating element is coupled to the body for heating the water within the hollow. A sensing element is disposed in the hollow of the body for detecting the presence of water in the hollow. The sensing element is located above the heating element. The sensing element includes a positive temperature coefficient (PTC) thermistor. A controller is operably connected to the sensing element and the heating element. The controller is configured to measure voltage across the PTC thermistor prior to energization of the heating element and prevent electrical power supply to the heating element if the measured voltage across the PTC thermistor is greater than a threshold voltage.

DETAILED DESCRIPTION

It should, of course, be understood that the description and drawings herein are merely illustrative and that various modifications and changes can be made in the structures disclosed without departing from the present disclosure. It will also be appreciated that the various identified components of the water heater and dry fire protection system disclosed herein are merely terms of art that may vary from one manufacturer to another and should not be deemed to limit the present disclosure.

Figure 1:
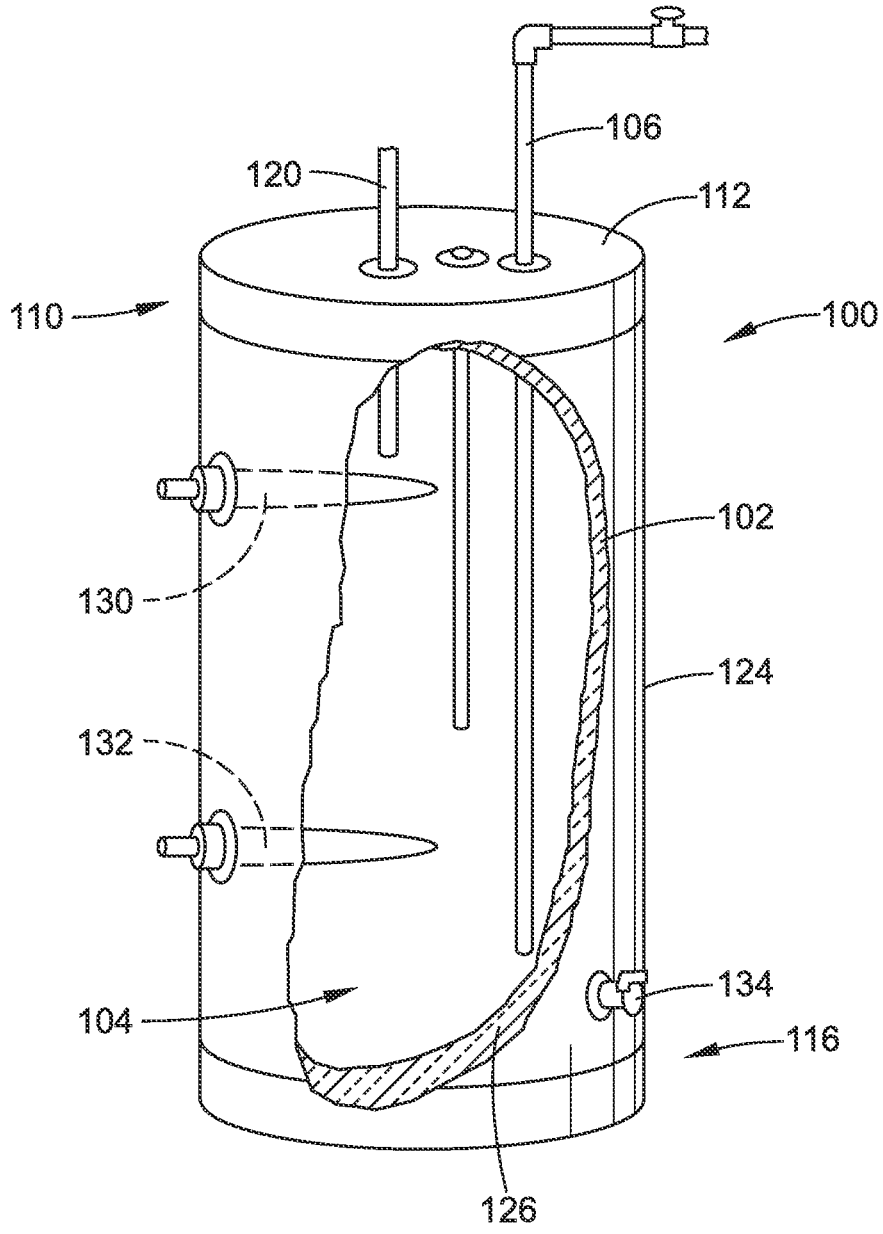
FIG. 1 is a perspective view, partially broken away of a conventional water heater.

Referring now to drawings, wherein like numerals refer to like parts throughout the several views, FIG. 1 illustrates a typical water heater 100. The water heater includes a tank or body 102 having a chamber or elongated hollow 104 for receiving water. An inlet pipe 106 extends through an upper portion 110, particularly a top wall 112, of the tank and into the chamber for admitting relatively cold water through an elongated hollow tube 114 that introduces water into a lower portion 116 of the tank. An outlet pipe 120 extends through the upper portion of the tank for permitting flow of relatively hot water from the chamber. The water tank 100 is encased by a housing or wrapper 124. An inner surface of the housing and an outer surface of the water tank together define an insulation volume 126 that serves to insulate the tank from the external environment. Upper and lower electric resistance type heating elements 130 and 132, respectively, are mounted to the side of tank 102 and extend into the chamber. The heating elements can be selectively energized to supply heat to the tank-stored water under the control of a thermostat or other temperature sensing device which monitors the temperature of the stored water.

Figures 2, 3, 4, 5, 6:
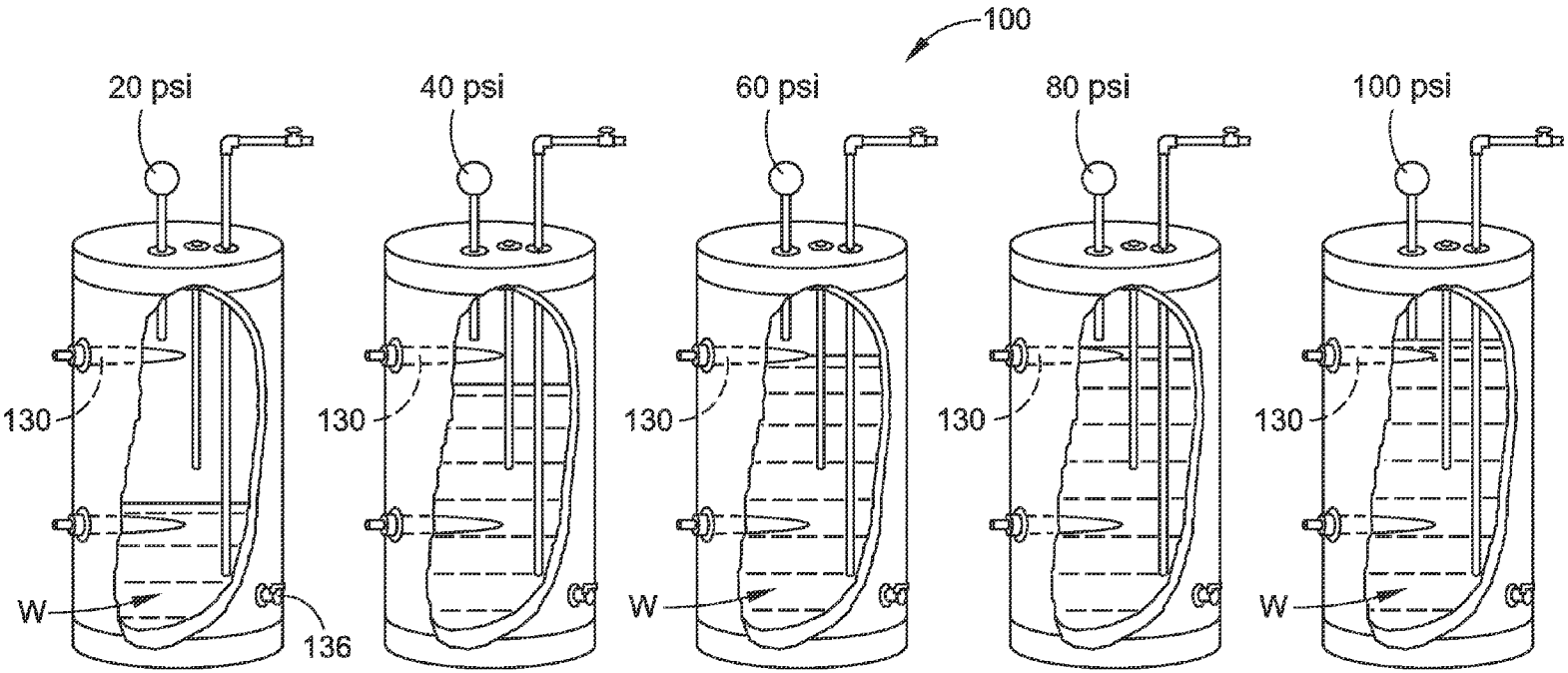
FIGS. 2-6 illustrate dry fire scenarios when the water heater of FIG. 1 is installed with different inlet water pressure levels and a water outlet drainage valve of the water heater is not open.

As indicated previously, the electric water heater 100 is sold without water in the chamber 104 and is filled with water after it is moved to and installed in its intended operation location. The possibility exists that the water heater can be have its heating element(s) 130, 132 energized before the chamber 104 of the water heater is filled with water to immerse the heating element(s) projecting into its interior. When such dry firing occurs, each dry fired electric heating element typically burns out, resulting in a return of the unit to the manufacturer, or a service call by a repair technician to perform an on-site heating element replacement. The cost of either repair procedure can be quite substantial. FIGS. 2 through 6 illustrate dry fire scenarios when the water heater 100 is installed with different inlet water pressure levels (e.g., 20 psi, 40 psi, 60 psi, 80 psi and 100 psi) and a water outlet drainage valve 134 of the water heater is not open. As shown in FIGS. 2-4, at inlet water pressure levels ranging from about 20 psi to about 60 psi, the upper heating element 130 is not completely immersed with water W at installation and dry fire can occur. At inlet water pressure levels of ranging from about 80 psi to about 100 psi, the upper heating element 130 is immersed with water at installation and no dry fire occurs. It should also be appreciated that water heater can be dry fired after installation, for example, if the water outlet drainage valve 134 located on a bottom portion of the tank is opened causing the water to drain out of the tank 102.

Figure 7:
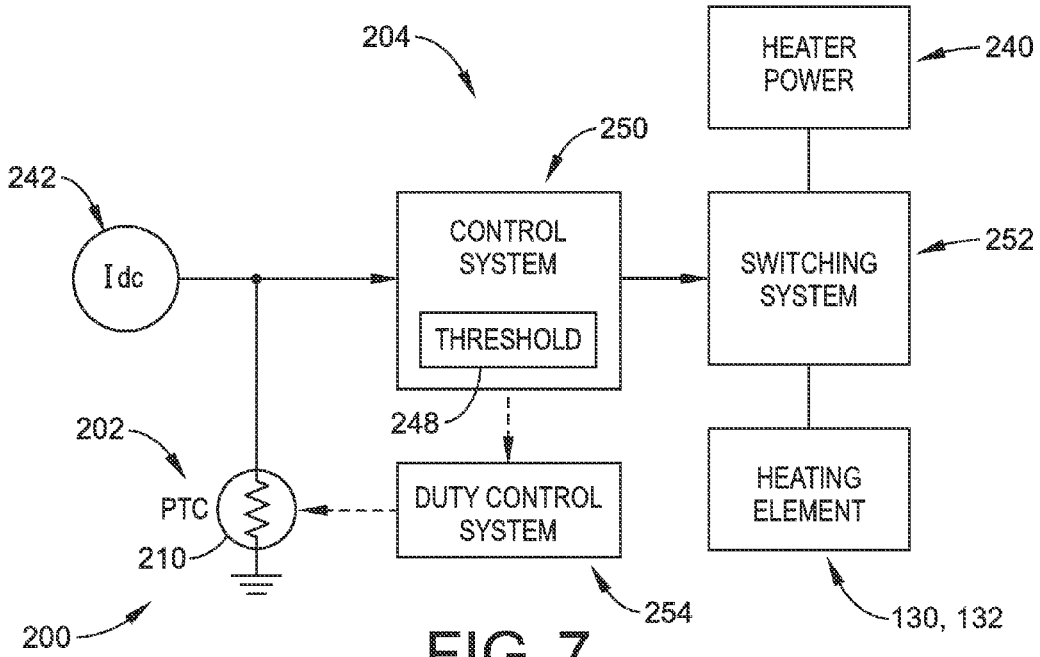
FIG. 7 schematically illustrates a dry fire protection system according to one aspect of the present disclosure.
Figure 8:
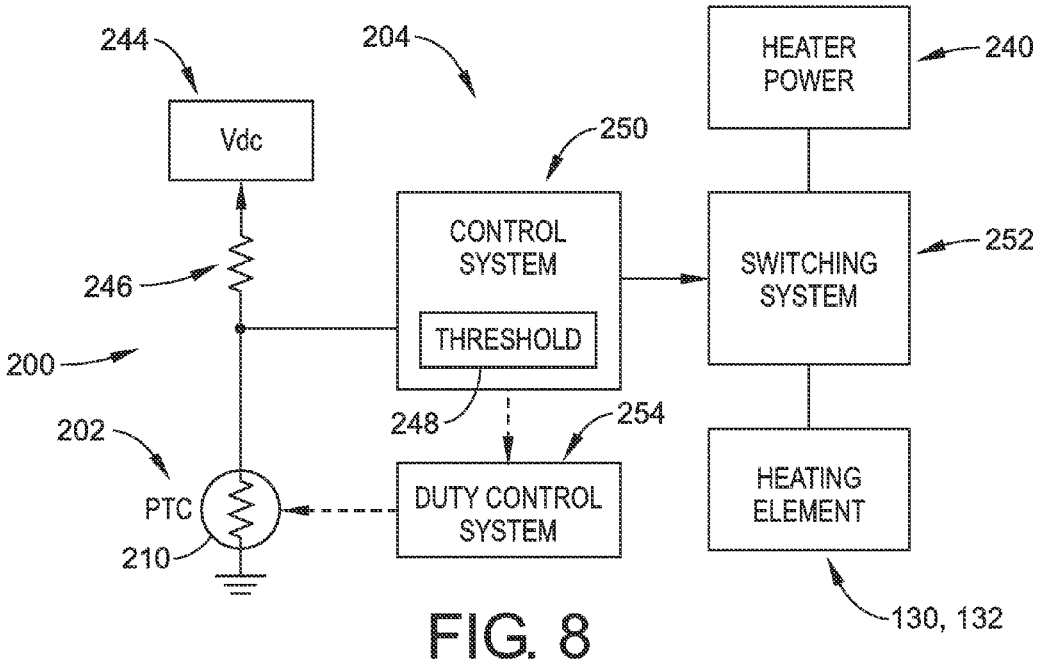
FIG. 8 schematically illustrates a dry fire protection system according to another aspect of the present disclosure.
Figure 9:
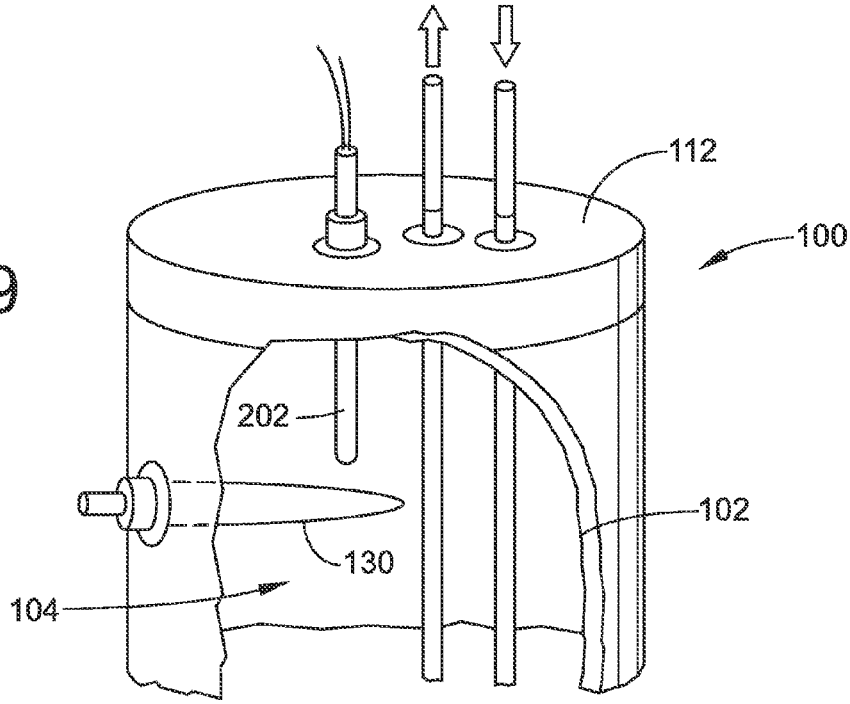
FIGS. 9 and 10 are enlarged partial perspective views of the water heater of FIG. 1 including a sensing element according to the present disclosure.
Figure 10:
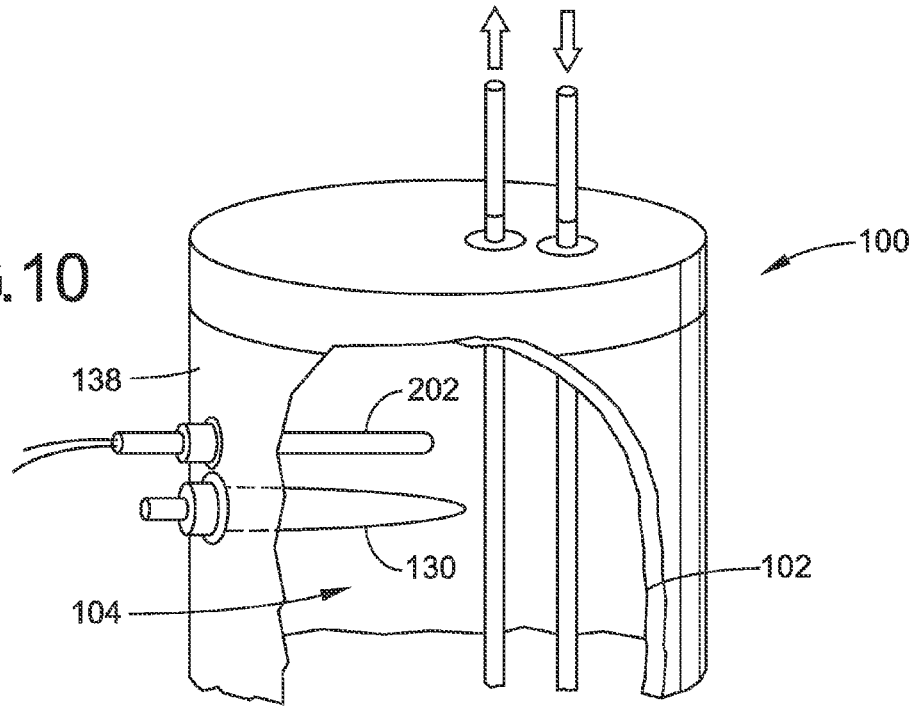

To prevent dry fire, a dry fire protection system 200 according to the present disclosure is schematically illustrated in FIGS. 7 and 8. The system 200 prevents dry fire not only during installation of the water heater 100 and but anytime the heating element(s) 130, 132, specifically the upper heating element 130, is not immersed with water. The dry fire protection system 200 comprises a sensing element 202 and a controller 204 operably connected to the sensing element. As shown in FIGS. 9 and 10, the sensing element 202 is disposed in the elongated hollow 104 of the body 102 for detecting the presence of water in the hollow. The sensing element is a separate component which can be mounted to one of the top wall 112 and side wall 138 of the tank 102 and is spaced above the upper heating element 130. As will be discussed in greater detail below, the sensing element 202 is configured to sense water level prior to energization of the heating elements.

Figure 11:
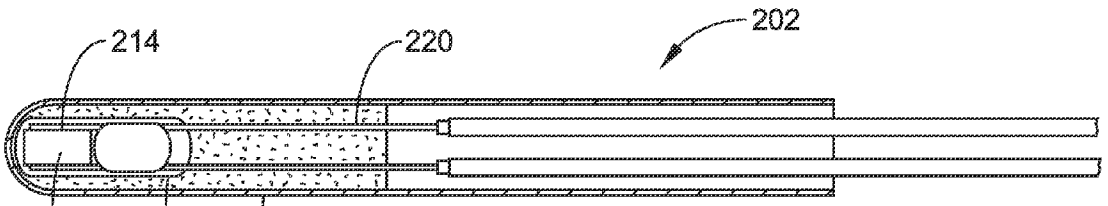
FIG. 11 is a schematical illustration of the sensing element according to one aspect of the present disclosure.

With reference to FIG. 11, according to one aspect of the present disclosure, the sensing element 202 can include a positive temperature coefficient (PTC) element or thermistor 210 housed within a housing 212. The PTC thermistor exhibits an increase in electrical resistance when subjected to an increase in temperature. The housing is generally tube shaped and can be made from a stainless steel material. A diameter of the housing should be such that the PTC element is as close to the wall of the housing as is possible; although, this is not required. The PTC element, which can be at least partially encapsulated with a high thermal conductive material 214, is hermetically sealed in a glass envelope 216. The envelope can be integral with the PTC element; although, this is not required. The envelope 216 is positioned adjacent an end section of the housing 212. Insulation tubing 220 isolates lead wires (not shown) which extending from the PTC element.

Figure 12:
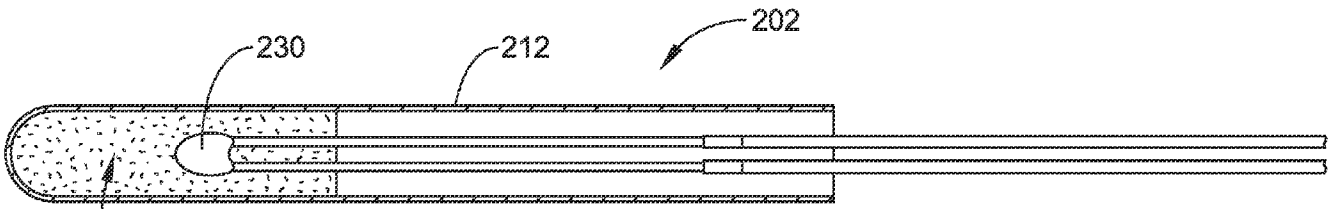
FIGS. 12 and 13 are schematical illustrations of the sensing element according to another aspect of the present disclosure.
Figure 13:
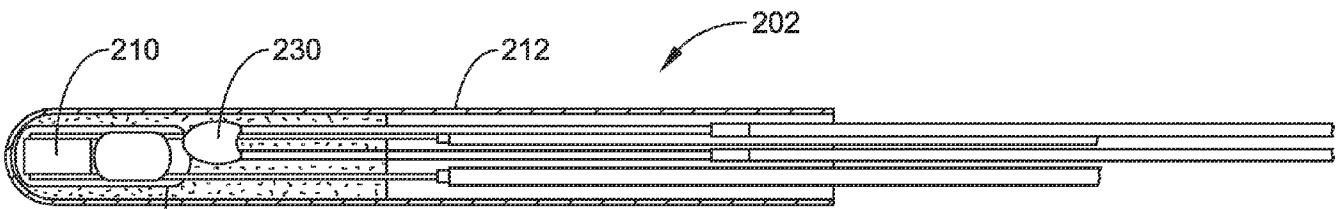

As shown in FIGS. 12 and 13, according to another aspect of the present disclosure, the sensing element 202 can further include a separate temperature sensitive element 230 for sensing temperature of the water in the hollow. As is well known, the heating elements 130, 132 can be controlled or selectively energized as a function of sensed water temperature. The temperature sensing element 230 is located within the housing 212, spaced from the PTC element 210 and can be at least partially encapsulated by a high thermal conductivity filler resin 232. As shown, the temperature sensing element is a negative temperature coefficient (NTC) thermistor, which exhibits a decrease in electrical resistance when subjected to an increase in temperature.

With reference again to FIGS. 7 and 8, the sensing element 202 is operably connected to the heating elements 130, 132. In one embodiment (see FIG. 7), the sensing element receives a constant current 242 to heat the PTC element 210. In another embodiment (see FIG. 8), the sensing element receives a low voltage (e.g., 12 volts dc) from a separate voltage source 244 to heat the PTC element. In this embodiment, a separate resistor 246 is positioned between the source of low voltage 242 and the sensing element 210. The PTC element exhibits a large, predictable and precise change in electrical resistance when subjected to a corresponding change in temperature which exceeds a critical temperature. If the sensing element 202 is immersed with water, there will be a negligible change in temperature. However, if there is no water to remove the heat generated by the PTC element 210, the sensing element 202 will generate a voltage in response to a rise in temperature that exceeds a critical temperature. In other words, the sensing element 202 is configured such that a change in voltage is registered in response to a change in the thermal dissipation capability of the sensing element. The controller 204 is configured to monitor the voltage across the sensing element 202. If the voltage is greater than a predetermined threshold voltage or value 248, the controller 204 is configured to prevent a separate supply of electrical power 240 to the heating elements 130, 132. Thus, the energization of the heating elements is a function of the generated voltage of the sensing element.

The controller 204 includes a control system 250 and a switching system 252 operably connected to the control system. The control system 250 is configured to measure voltage across the sensing element 202 and compare the measured voltage to the threshold voltage. The switching system 252 is configured to cut off electrical power supplied to the heating elements 130, 132 if the measured voltage is greater than the threshold voltage. The controller can further include a duty cycle control 254 operably connected to both the control system 250 and the sensing element 202 for cyclically energizing the sensing element to maintain a thermal state of the sensing element. The duty cycle control 254 controls current over time to the PTC element 210. This cyclical energization of the PTC element is particularly important in warm conditions where the PTC element 210 has an initial warm temperature. Due to the initial warm temperature of the PTC element, the PTC element will not require much thermal energy to exceed the critical temperature. The cyclical energization of the sensing element can prevent the controller 204 from prematurely cutting power to the heating elements 130, 132.

Figure 14:
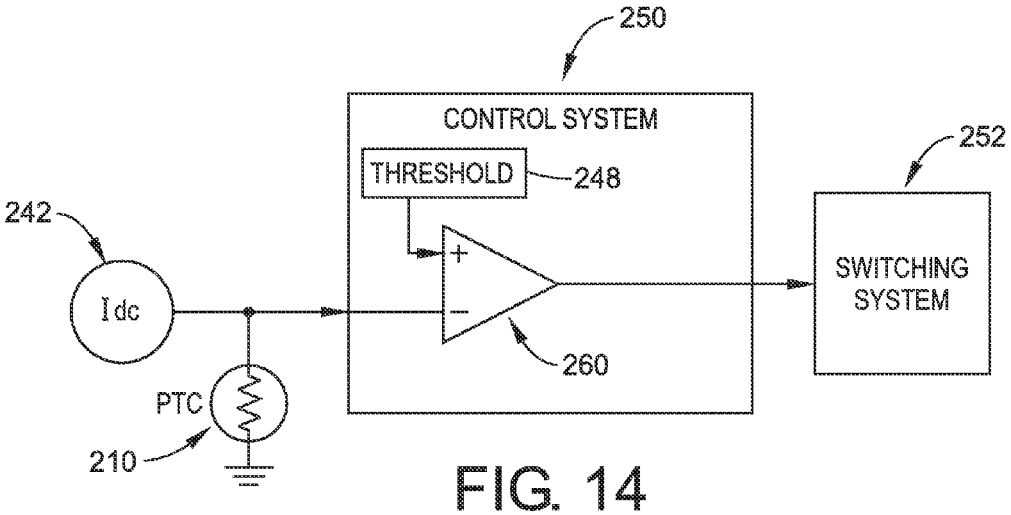
FIG. 14 schematically illustrates a control system of the dry fire protection systems of FIGS. 7 and 8 according to one embodiment of the present disclosure.
Figure 15:
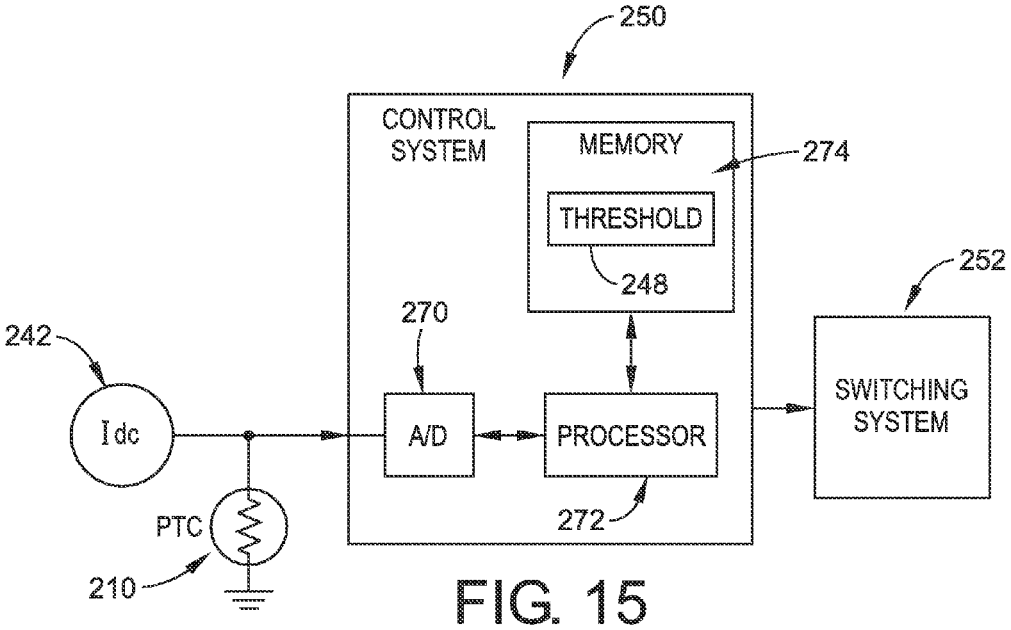
FIG. 15 schematically illustrates a control system of the dry fire protection systems of FIGS. 7 and 8 according to another embodiment of the present disclosure.

As shown in FIG. 14, in one embodiment, the control system 250 includes a voltage comparator 260. As is well known, the voltage comparator is a device which compares two voltages or currents and switches its output to on or off to indicate which is larger. The voltage comparator is electrically connected to the sensing element 202 for detecting the voltage across the sensing element and comparing the measured voltage to the threshold voltage 248. If the detected voltage exceeds the threshold voltage 248, an output of the control system will trigger the switching system 252 to prevent the delivery of heater power 240 to the heating elements 130, 132. As shown in FIG. 15, in another embodiment, the control system 250 includes an analog to digital convertor 270. As is well known, the A/D convertor is configured to convert an analog voltage generated by the sensing element 202 into a digital value. A processor 272 is connected to the A/D convertor 270 and is configured to compare the digital value to the prerecorded digital value or threshold value 248 stored in a memory 274. If the digital value exceeds the prerecorded memory value, and similar to the hardware embodiment described above, an output of the control system 250 will trigger the switching system 252 to prevent the delivery of heater power 240 to the heating elements 130, 132. As shown, the A/D convertor, processor and memory are integrated as a single component; although it should be appreciated that each can be a separate component.

Figure 16:
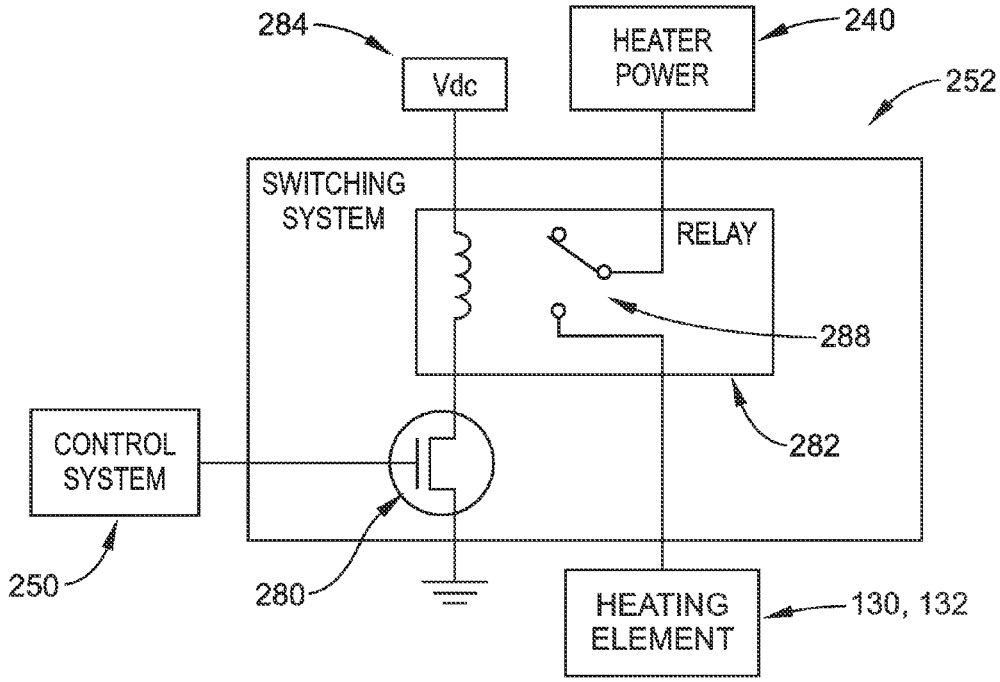
FIG. 16 schematically illustrates a switching system of the dry fire protection systems of FIGS. 7 and 8 according to one embodiment of the present disclosure.
Figure 17:
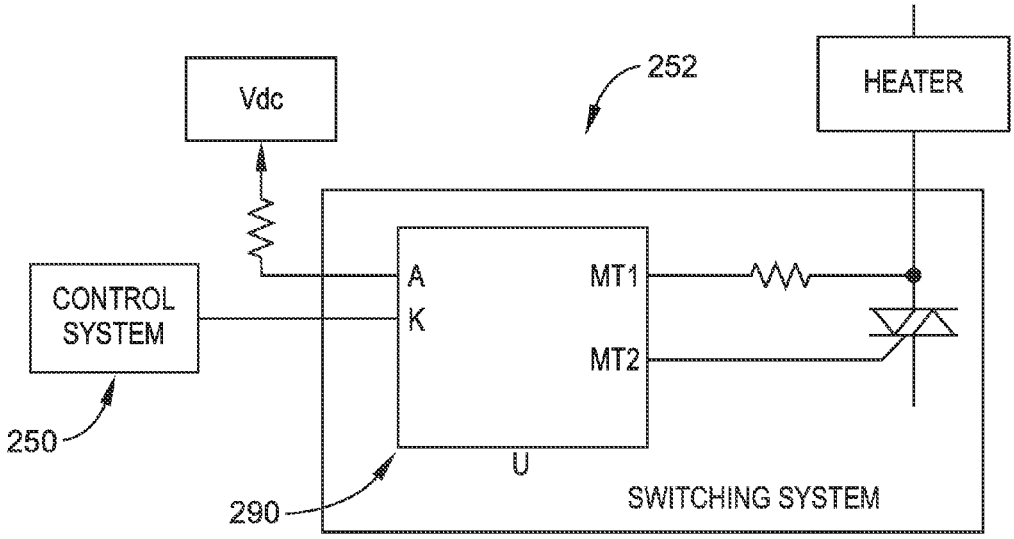
FIG. 17 schematically illustrates a switching system of the dry fire protection systems of FIGS. 7 and 8 according to another embodiment of the present disclosure.

With reference now to FIG. 16, according to one aspect of the present disclosure, the low power switching system 252 can include a switch 280, a normally open relay 282 and a separate voltage supply or source 284. The switch is electrically connected in series with the coil of the relay and the separate voltage source and can be opened by the control system 250 to prevent energization of the normally open relay thereby preventing energization of the heating element(s) 130, 132. Particularly, if the voltage across the PTC element 210 does not exceed the predetermined threshold value, the control system 252 will trigger the switch 280 into its closed condition. This, in turn, will allow current to flow through the coil of the relay 282, closing a relay switch 288 and allowing power to be delivered from the heater power source 240 through the relay and to the heating element(s) 130, 132. If the voltage across the PTC element 210 exceeds the threshold value, the control system will trigger the switch to its open condition. This, in turn, will prevent current through the coil of the relay 282 thereby preventing the supply of electrical power 240 to the heating element(s). It should be appreciated that alternative switching systems are contemplated. For example, as shown in FIG. 17, the switching system 252 can include a triac or bidirectional triode thyristor 290. As is well known, the triac results in a bidirectional electronic switch which can conduct current in either direction when it is triggered (turned on). It can be triggered by either a positive or a negative voltage being applied to its gate electrode (with respect to A, otherwise known as MT1). Once triggered, the triac 290 continues to conduct until the current through it drops below a certain threshold value.

As is evident from the foregoing, the present disclosure provides a method of controlling the heating element(s) 130, 132 of the water heater 100 to prevent dry fire. The sensing element 202 including the PTC element 210 is positioned in the water heater and is spaced above the upper heating element 130. Voltage across the PTC element is sensed prior to energization of the heating element(s). The sensed voltage is compared to the threshold voltage or value. Electrical power 240 supplied to the heating element(s) is controlled or cut off as a function of the sensed or measured voltage across the PTC element via the controller 204. The controller includes the control system 252 and the switching system 254. In one exemplary embodiment, the control system 250 includes the voltage comparator which is electrically connected to the PTC element for detecting the voltage across the PTC element. Alternatively, the control system senses voltage across the PTC element 210 and convert the sensed voltage into a digital value via an analog to digital convertor. The digital value is then compared to a prerecorded memory value. In one exemplary embodiment, the switching system includes the relay 282 which is electrically connected to the control system. The relay is configured to be tripped to prevent the supply of electrical power to the heating element. The sensing element 202 can further includes a temperature sensitive element 230 for sensing temperature of the water in the hollow. The heating elements can be controlled as a function of sensed temperature.

Figure 18:
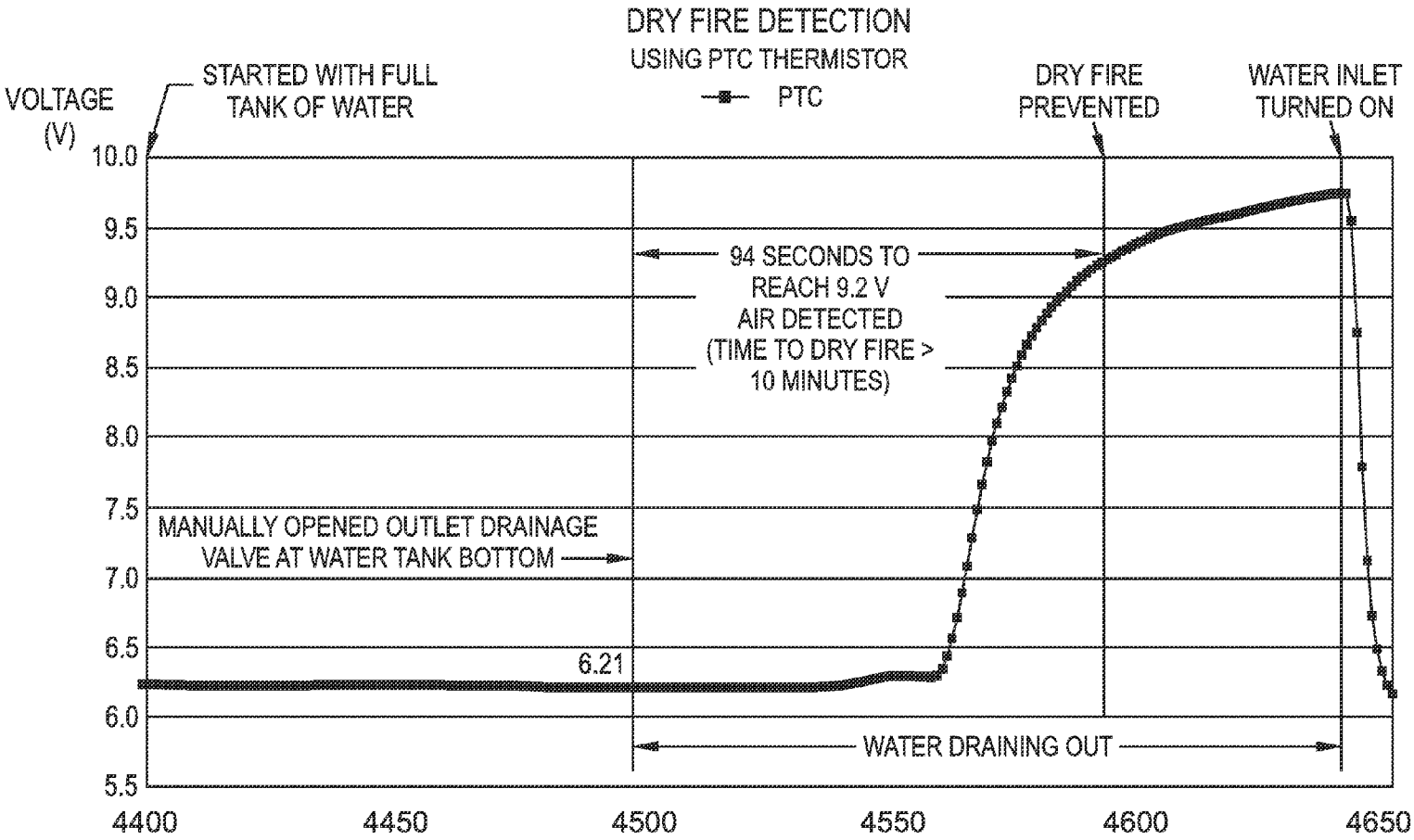
FIG. 18 graphically illustrates an operation of the dry fire protection systems of FIGS. 7 and 8.

As indicated previously, the dry fire protection system 200 can protect the heating elements 130, 132 during and after installation of the water heater 100. For example, and with reference to FIG. 18, with the PTC element 210 immersed with water (i.e., when the tank is filled with water), the voltage across the PTC element remains relatively constant. If water begins to drain out of the tank, for example, by opening the outlet drainage valve, the voltage across the PTC element rapidly rises. After a short period of time (in the illustrated example, 94 seconds) the voltage across the PTC element exceeds the threshold valve and the controller 204 cuts off power to the heating elements thereby preventing dry fire.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A dry fire protection system for a water heater, the water heater including a body having an elongated hollow for holding water to be heated, an inlet opening and an outlet opening in communication with the hollow for flowing water therethrough, and a heating element coupled to the body for heating the water within the hollow, the dry fire protection system comprising:

a sensing element disposed in the hollow of the body and configured for detecting the presence of water in the hollow, the sensing element being spaced apart and separately located from the heating element, the sensing element being configured to generate a voltage in response to a temperature of the sensing element;

a first electrical power supply providing electrical power to the sensing element;

a second electrical power supply providing electrical power to the heating element; and a controller operably connected to the sensing element for monitoring the generated voltage across the sensing element, wherein the controller is configured to prevent a supply of electrical power from the second electrical power supply to the heating element when the generated voltage is above a threshold voltage to prevent a dry fire condition.

2. The system of claim 1, wherein the sensing element is located above the heating element and is configured to sense water level prior to energization of the heating element.

3. The system of claim 1, wherein the controller includes a control system and a switching system operably connected to the control system, the control system being configured to measure the generated voltage across the sensing element and compare the measured voltage to the threshold voltage, the switching system being configured to cut off electrical power supplied to the heating element if the measured voltage is greater than the threshold voltage.

4. The system of claim 3, wherein the control system includes a voltage comparator electrically connected to the sensing element for detecting the generated voltage across the sensing element and comparing the detected voltage to the threshold voltage.

5. The system of claim 3, wherein the control system includes an analog to digital convertor configured to convert an analog voltage generated by the sensing element into a digital value, and a processor configured to compare the digital value to a prerecorded memory value.

6. The system of claim 3, wherein the switching system includes a relay, the relay being tripped by the control system to prevent the supply of electrical power to the heating element.

7. The system of claim 6, wherein the switching system include a switch electrically connected to the relay and a separate voltage source, the switch being opened by the control system to prevent the supply of voltage across the relay.

8. The system of claim 1, wherein the controller includes a duty cycle control operably connected to both the control system and the sensing element for cyclically energizing the sensing element to maintain a thermal state of the sensing element.

9. The system of claim 1, wherein the sensing element includes a positive temperature coefficient (PTC) element, and the sensing element further includes a separate temperature sensitive element for sensing temperature of the water in the hollow, the controller controlling the heating element as a function of sensed temperature, and a housing for enclosing together the PTC element and the temperature sensitive element.

10. The system of claim 9, wherein the temperature sensing element is a negative temperature coefficient thermistor.

11. The system of claim 9, further including a high thermal conductive material disposed within the housing and at least partially encapsulating the PTC element and the temperature sensitive element, and the PTC element being separately sealed in an envelope.

12. A method of controlling a heating element of a water heater to prevent dry fire, the water heater comprising a controller, a sensing element coupled to the controller and being powered by a first electrical power source, the sensing element being spaced apart and separately located from the heating element and including a positive temperature coefficient (PTC) element, and a second electrical power source coupled to the heating element and being controlled by the controller, wherein the method comprises the controller controlling power to the PTC element and sensing a voltage across the PTC element prior to energization of the heating element;

comparing the sensed voltage to a threshold voltage; and preventing a supply of electrical power from the second electrical power source to the beating element when the sensed voltage across the PTC element is greater than the threshold voltage.

13. The method of claim 12, wherein the sensing element is spaced above the heating element.

14. The method of claim 12, wherein preventing the supply of electrical power from the second electrical power source to the heating element includes the controller cutting off power supplied to the heating element from the second electrical power source when the sensed voltage across the PTC element is greater than the threshold voltage.

15. The method of claim 12, wherein preventing the supply of electrical power from the second electrical power source to the heating element comprises:

the controller monitoring an output of a voltage comparator coupled to the PTC element for sensing the voltage across the PTC element, and controlling a switching of a relay to prevent the supply of electrical power from the second electrical power source to the heating element when the sensed voltage across the PTC element is greater than the threshold voltage.

16. The method of claim 12, wherein sensing the voltage across the PTC element comprises converting the sensed voltage across the PTC element into a digital value with an analog to digital convertor, and comparing the digital value to a prerecorded memory value.

17. The method of claim 12, wherein the sensing element comprises a temperature sensitive element for sensing temperature of the water heater, wherein the controller is configured to control the supply of electrical power to the heating element from the second electrical power source as a function of sensed temperature.

18. A water heater comprising:

a body having an elongated hollow for holding water to be heated;

an inlet opening and an outlet opening in communication with the hollow for flowing water therethrough;

a heating element coupled to the body for beating the water within the hollow;

a sensing element disposed in the hollow of the body and configured for detecting the presence of water in the hollow, the sensing element being located above the heating element, the sensing element including a positive temperature coefficient (PTC) thermistor;

a first electrical power supply providing electrical power to the sensing element;

a second electrical power supply providing electrical power to the heating element; and a controller operably connected to the sensing element and the second electrical power supply powering the heating element, the controller being configured to measure a voltage across the PTC thermistor prior to energization of the heating element and prevent the second electrical power supply from providing electrical power to the heating element if the measured voltage across the PTC thermistor is greater than a threshold voltage.

19. The water heater of claim 18, wherein the sensing element is configured to sense water level within the hollow prior to energization of the heating element to prevent dry fire, and wherein the body includes a top wall, the sensing element being mounted to the top wall.

20. The water heater of claim 18, wherein the sensing element includes a negative temperature coefficient (NTC)

thermistor for sensing temperature of the water in the hollow, and a housing for enclosing together the PTC thermistor and the NTC thermistor.

* * * * *